US010694905B2

(12) United States Patent
Murai et al.

(10) Patent No.: US 10,694,905 B2
(45) Date of Patent: Jun. 30, 2020

(54) HAND DRYER DEVICE

(71) Applicant: Mitsubishi Electric Corporation, Chiyoda-ku, Tokyo (JP)

(72) Inventors: Ryota Murai, Tokyo (JP); Tatsuya Fujimura, Tokyo (JP); Ryoji Mori, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 94 days.

(21) Appl. No.: 15/741,879

(22) PCT Filed: Jul. 14, 2015

(86) PCT No.: PCT/JP2015/070174
§ 371 (c)(1),
(2) Date: Jan. 4, 2018

(87) PCT Pub. No.: WO2017/009952
PCT Pub. Date: Jan. 19, 2017

(65) Prior Publication Data
US 2018/0199769 A1 Jul. 19, 2018

(51) Int. Cl.
*A47K 10/48* (2006.01)

(52) U.S. Cl.
CPC ..... *A47K 10/48* (2013.01)

(58) Field of Classification Search
CPC ..... A47K 10/48
(Continued)

(56) References Cited

U.S. PATENT DOCUMENTS 5,031,337 A * 7/1991 Pilolla ..... A47K 10/48 34/202
2013/0139400 A1* 6/2013 Fukano ..... A47K 10/48 34/202

FOREIGN PATENT DOCUMENTS

JP 2002-177165 A 6/2002
JP 2010-220925 A 10/2010
(Continued)

OTHER PUBLICATIONS

Communication and Supplementary European Search Report for corresponding EP Application No. 15898264.5 dated May 14, 2018, 7 pages.
(Continued)

*Primary Examiner* — John P McCormack
(74) *Attorney, Agent, or Firm* — Buchanan Ingersoll & Rooney PC

(57) ABSTRACT

A hand dryer device includes nozzles to blow airflows into a hand-placeable drying portion, a blower to generate the airflow to be blown out of the nozzles, a sensor having a light-emitting element to detect the presence or absence of a hand in the drying portion, and a controller to make a hand detection determination of whether the hand is present or absent in the drying portion based on a detection result of the sensor, and control driving of the blower based on a determination result of the hand detection determination. The controller controls an intermittent driving of the light-emitting element of the sensor. In first and second driving cycles of the sensor, when a determination result in the first driving cycle and a first determination result in the second driving cycle differ from each other, the controller extends a driving period of the sensor in the second driving cycle.

11 Claims, 9 Drawing Sheets

(58) Field of Classification Search
USPC ..... 34/443, 96, 283, 413
See application file for complete search history.

(56) References Cited

FOREIGN PATENT DOCUMENTS

| | | | |
|---|---|---|---|
| JP | 2014-036790 | A | 2/2014 |
| TW | 309748 | U | 7/1997 |

OTHER PUBLICATIONS

Office Action (Patent Examination Report No. 1) dated Jun. 15, 2018, by the Australian Patent Office in corresponding Australian Patent Application No. 2015401986. (3 pages).
*International Search Report (PCT/ISA/210) dated Sep. 15, 2015, by the Japanese Patent Office as the International Searching Authority for International Application No. PCT/JP2015/070174.
*Written Opinion (PCT/ISA/237) dated Sep. 15, 2015, by the Japanese Patent Office as the International Searching Authority for International Application No. PCT/JP2015/070174.
*TW Notice of Rejection of TW Patent Application No. 105100769, dated May 9, 2017, 8 pages with English translation of relevant parts.
*TW Decision of Final Refusion of TW Patent Application No. 105100769, dated Oct. 18, 2017, 6 pages with Machine Translation.
The Second Office Action dated Mar. 12, 2020, by the State Intellectual Property Office in People's Republic of China in corresponding Chinese Patent Application No. 201580081274.0 and an English translation of the Office Action. (14 pages).

* cited by examiner

HAND DRYER DEVICE

FIELD

The present invention relates to a hand dryer device for drying a wet hand.

BACKGROUND

Maintaining a hand under hygienic conditions not only requires cleaning of the hand, but also requires drying to be performed hygienically after the cleaning. To this end, instead of wiping the wet hand after cleaning using a hand-drying cloth, such as a towel or a handkerchief, a hand dryer device is used in which a hand is inserted to an insertion space, and a high speed airflow is injected to the inserted hand to blow water away from the hand, thus drying the hand.

Examples of such hand dryer device include a hand dryer device disclosed in Patent Literature 1. For the disclosed hand dryer device, a hand detection means disposed near a hand insertion portion detects a hand, and a control unit actuates a gas supply unit, such that high pressure air generated by the gas supply unit is converted into a high speed airflow by means of a gas jetting outlet to allow the high speed airflow to jet into the hand insertion portion. The hand dryer device of Patent Literature 1 intermittently drives the hand detection unit at preset time intervals, and when a hand is not detected for a predetermined time period, increases the cycle time of the intermittent driving for reducing the power consumption of the hand detection means.

CITATION LIST

Patent Literature

Patent Literature 1: Japanese Patent Application Laid-Open No. 2002-177165

SUMMARY

Technical Problem

However, the hand dryer device of Patent Literature 1 described above suffers from a problem of false detection of an output of the hand detection means due to noise when only one determination of hand detection result is made. When two or more determinations are made for hand detection to reduce or prevent the false detection due to noise, on the other hand, the hand detection determination requires a time equivalent to plural cycles of intermittent driving of the hand detection sensor. This poses a problem of the hand detection determination being delayed, resulting in the long drying time.

Moreover, the cycle time of the intermittent driving of the hand detection unit increases in the absence of detection of a hand. As a result, a time necessary for the next determination of hand detection increases, thereby unfortunately, delaying the hand detection determination, which results in the long drying time.

The present invention has been made in view of the foregoing, and therefore an object of the present invention is to provide a hand dryer device that achieves high accuracy hand detection, starts to operate quickly, and is user friendly.

Solution to Problem

To solve the problems described above and to achieve the above object, the present invention provides a hand dryer device comprising: a nozzle to blow an airflow into a drying space in which a hand is placeable; a blower unit to generate the airflow to be blown out of the nozzle; a hand detection unit having a light-emitting element to detect presence or absence of the hand in the drying space; and a control unit to make a hand detection determination of whether the hand is present or absent in the drying space on the basis of a detection result of the hand detection unit, and to control driving of the blower unit on the basis of a determination result of the hand detection determination, wherein the control unit controls an intermittent driving of the light-emitting element of the hand detection unit, and, in consecutive first and second driving cycles of the hand detection unit, when the determination result in the first driving cycle and the first determination result in the second the driving cycle differ from each other, extends a driving period of the hand detection unit in the second operation cycle.

Advantageous Effects of Invention

A hand dryer device according to the present invention is advantageous because the hand dryer device achieves the high accuracy hand detection, starts to operate quickly, and is user friendly.

DESCRIPTION OF EMBODIMENT

A hand dryer device according to an embodiment of the present invention will be described below in detail with reference to the drawings. It is to be understood that this invention is not limited to this embodiment.

Embodiment

Figure 1:
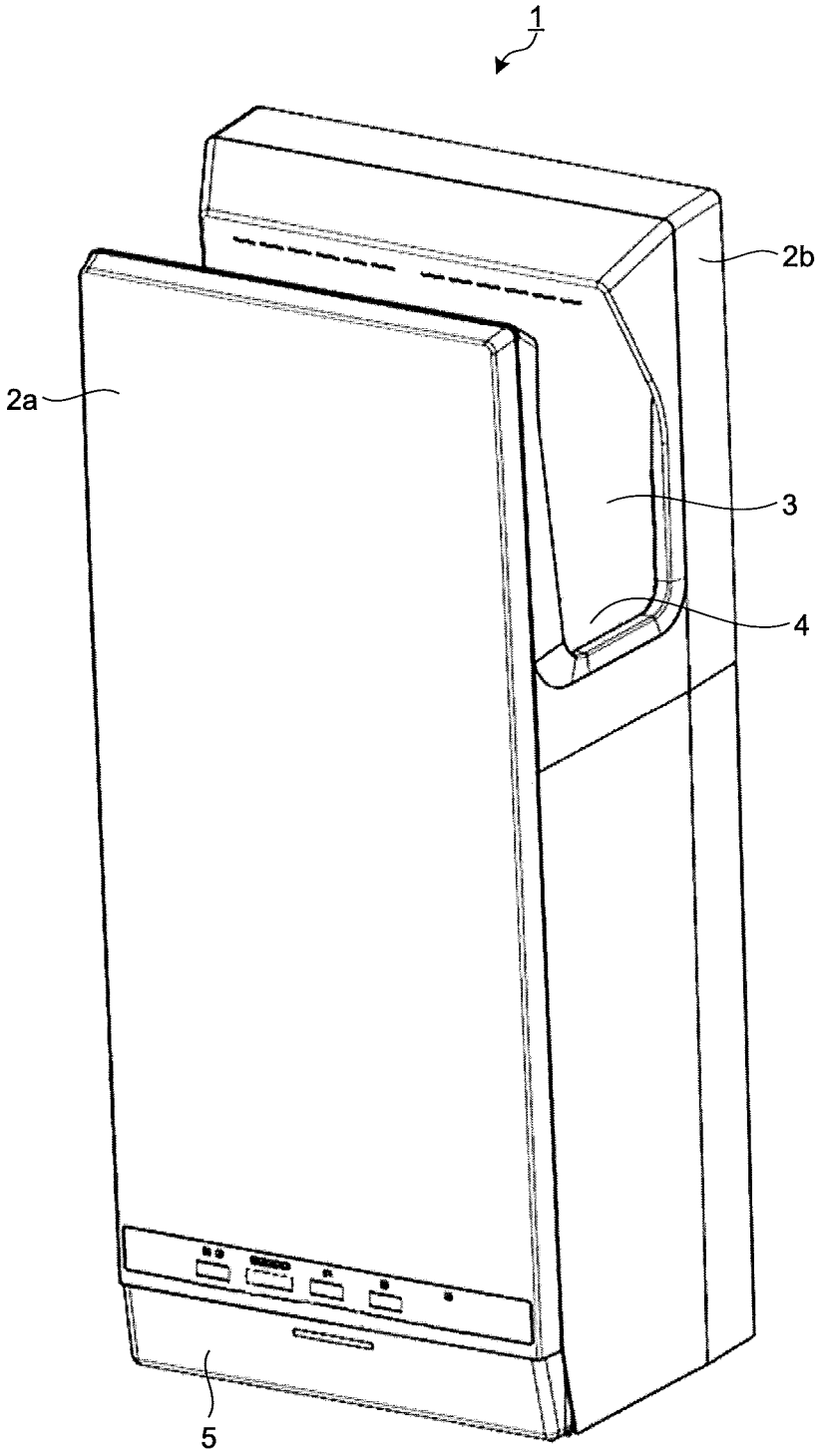
FIG. 1 is a perspective view of a hand dryer device according to the present embodiment.
Figure 2:
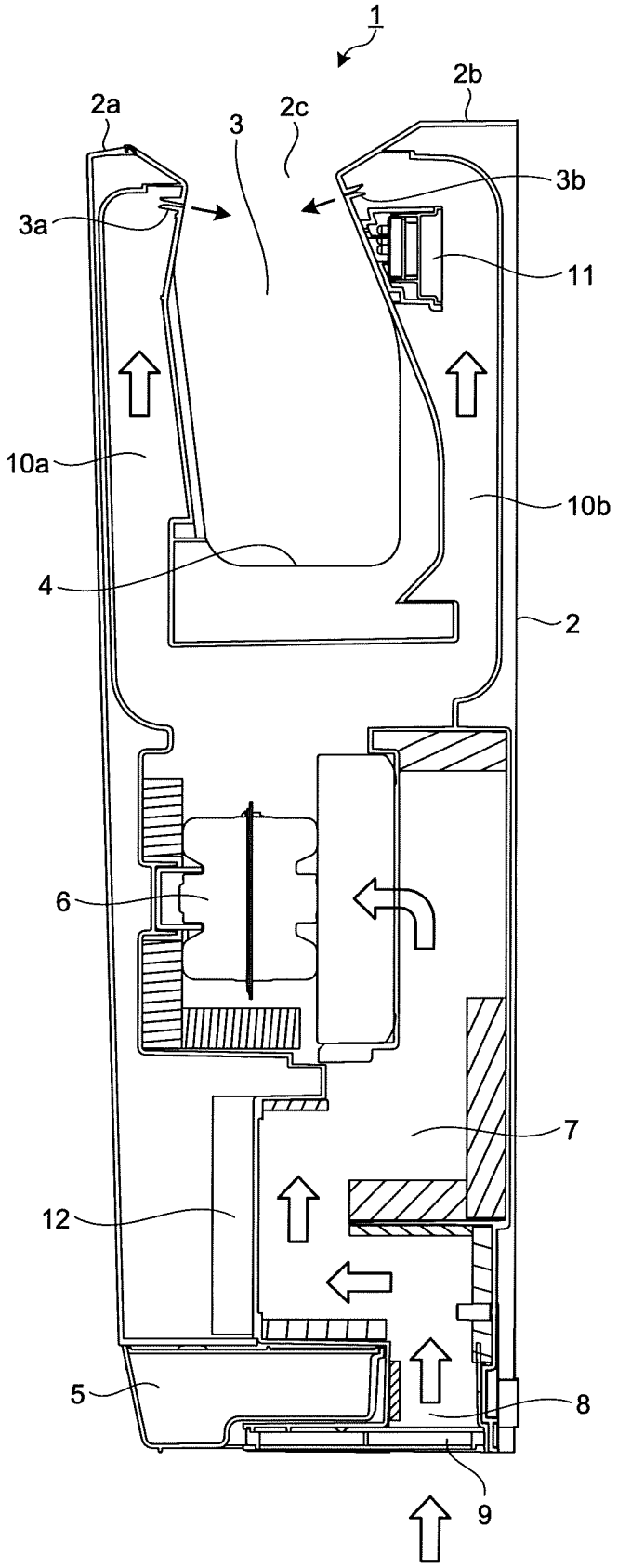
FIG. 2 is a side sectional elevation of the hand dryer device according to the embodiment of the present invention.

FIG. 1 is a perspective view of a hand dryer device 1 according to the present embodiment. FIG. 2 is a side sectional elevation of the hand dryer device 1 according to the embodiment of the present invention. As illustrated in FIG. 1, the hand dryer device 1 incorporates a blower unit 6 in a housing 2 thereof. The housing 2 has a hand drying portion 3 formed therein. The hand drying portion 3 defines a recess-shaped space opened at its upper end. The blower unit 6 generates high pressure air to be supplied to hand dryer nozzles 3*a* and 3*b*, such that a high speed airflow jetting as a working airflow from the hand dryer nozzles 3*a* and 3*b* blows away water on a hand (or both hands) inserted in the hand drying portion 3. The arrows in FIG. 2 indicate flows of air.

As illustrated in FIG. 2, the hand dryer device 1 includes an opening 2*c* in an upper portion of the housing 2 that defines an outer shell of the hand dryer device 1. The hand drying portion 3, which is provided in an upper portion of the housing 2 under the opening 2*c*, is a space to surround a hand of the user inserted through the opening 2*c*. The hand drying portion 3 is a drying space in which a user's hand is placeable when the user is to dry his hand using the hand dryer device 1. The hand drying portion 3 has a U-shaped cross section when viewed in side elevation. The hand drying portion 3 slightly inclines away from a front side of the hand drying portion 3 toward a back side of the hand drying portion 3 as the hand drying portion extends downwardly from its top.

The hand drying portion 3 is defined as a space between a front projection 2*a* and a rear projection 2*b*. The front projection 2*a* is an extended portion located on the front side, i.e., the side close to the user, and the rear projection 2*b* is an extended portion located on the back side, i.e., the side far from the user. The front projection 2*a* and the rear projection 2*b* are connected to a water collector 4 provided in a lowermost portion of the hand drying portion 3. As described above, the hand drying portion 3 has a U-shaped cross section having an open upper end and a closed bottom when viewed in side elevation. In addition, as illustrated in FIG. 1, the hand drying portion 3 is opened at opposite lateral sides thereof. Thus, the user can be free to insert and remove his hand into and from the hand drying portion 3 from above, from left, or from right.

The water collector 4 has a water outlet (not illustrated) in a portion thereof to discharge the water collected in the water collector 4. The water outlet is attached to an upper end portion of a drain (not illustrated) extending in an up-and-down direction in the housing 2. The drain has its lower end portion connected to a drain tank 5 provided in a bottom portion of the body of the hand dryer device. The drain tank 5 is used to store water discharged through the drain. The drain tank 5 is removably attached to a bottom portion of the housing 2. The water outlet is sloped to allow the water to flow down, such that the water adhered to the water collector 4 flows through the drain to be stored in the drain tank 5.

An inner wall of the front projection 2*a*, an inner wall of the rear projection 2*b*, and a surface of the water collector 4 are formed of a resin impregnated with an antimicrobial agent. In addition, the inner wall of the front projection 2*a*, the inner wall of the rear projection 2*b*, and the surface of the water collector 4 are coated with water repellent coating such as silicon-based or fluorine-based coating, or a hydrophilic coating such as one formed of titanium oxide. This configuration can reduce or prevent adhesion of contaminant to the inner wall of the front projection 2*a*, to the inner wall of the rear projection 2*b*, and to the surface of the water collector 4, and also can reduce growth of bacteria as well.

Disposed under the hand drying portion 3 within the housing 2 is the blower unit 6 that generates high pressure air, as illustrated in FIG. 2. The blower unit 6 has a back side defining an air intake side and a front side defining an air discharge side.

The air intake side of the blower unit 6 communicates with an upper portion of a duct 7 which is a vertically extending internal air passage defined on the back side within the housing 2. The duct 7 has a downwardly opened lower end defining an air intake 8. An air filter 9 is disposed in the air intake 8 to thereby allow external air to be taken into the duct 7 through the air filter 9.

The air discharge side of the blower unit 6 communicates with a lower portion of each of a front discharge duct 10*a* and of a back discharge duct 10*b*. The ducts 10*a*, 10*b* continuously vertically extend and are separated from each other on the front and back sides within the housing 2. The high pressure air pressurized by the blower unit 6 is discharged to the front discharge duct 10*a* and the back discharge duct 10*b* connected to the blower unit 6. The front discharge duct 10*a* and the back discharge duct 10*b* may incorporate a heater at a location from which the ducts 10*a*, 10*b* separately extend on the front and back sides, such that a temperature of the high pressure air passing through the heater is increased.

The hand dryer nozzle 3*a* and the hand dryer nozzle 3*b*, which act as jet ports, are respectively provided at upper portions of the front discharge duct 10*a* and of the back discharge duct 10*b*. That is, the hand dryer nozzle 3*a* for emitting a jet of air is provided on the inner wall of the front projection 2*a* in the vicinity of the opening 2*c* in the hand drying portion 3, while the hand dryer nozzle 3*b* for emitting a jet of air is provided on the inner wall of the rear projection 2*b* in the vicinity of the opening 2*c*. The hand dryer nozzle 3*a* and the hand dryer nozzle 3*b* face each other. The hand dryer nozzle 3*a* and the hand dryer nozzle 3*b* each have a plurality of somewhat corrugated pores that are opened in an obliquely downward direction. The pores are arranged in alignment in a horizontal direction, i.e., a width direction of the hand dryer device 1 when viewed in front elevation.

The hand dryer nozzle 3*a* and the hand dryer nozzle 3*b* each convert the high pressure air generated by the blower unit 6 into a high speed airflow, such that the high speed airflows jet as working airflows from the jet ports toward the hand drying portion 3. The working airflows jet from the hand dryer nozzles 3*a* and 3*b* in directions facing the hand drying portion 3 and slightly inclining downward at angles from the horizontal direction, such that water on the wrist, the palm, or the back of a hand of the user inserted to the hand drying portion 3 is blown away toward a lower portion of the hand drying portion 3.

A hand detection sensor 11 is incorporated below the hand dryer nozzle 3*b* in the rear projection 2*b*. When the user inserts his wet hand through the opening 2*c* deeply into the hand drying portion 3, the hand detection sensor 11 detects the inserted hand, and thus detects that the user's hand has been inserted into the hand drying portion 3. Upon detecting that the user's hand has been inserted into the hand drying portion 3, the hand detection sensor 11 outputs to a hand detection determination unit 22 as described later herein a hand detection signal indicating that the user's hand has been detected.

Examples of the hand detection sensor 11 include an infrared distance measurement sensor. The hand detection sensor 11 detects the presence or absence of the hand in the hand drying portion 3 on the basis of the angle of light as the light is emitted from a light-emitting element and received by a light-receiving element. It is understood that the hand detection sensor 11 is not limited to an infrared distance measurement sensor, and may be any sensor capable of detecting the presence or absence of the hand in the hand drying portion 3.

Figure 3:
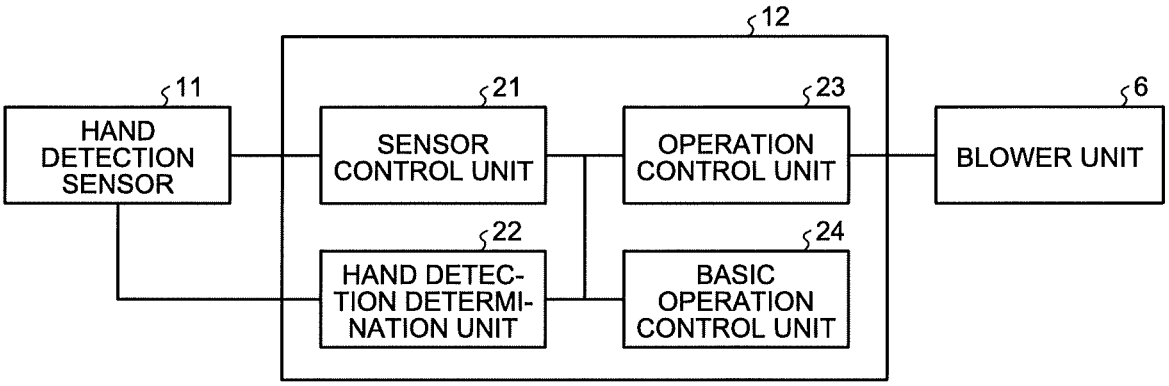
FIG. 3 is a functional block diagram of main parts of the hand dryer device according to the embodiment of the present invention.

A control unit 12 is incorporated in a lower portion of the housing 2 to control an operation of the blower unit 6 in response to the hand detection sensor 11 detecting the hand. The control unit 12 controls the operation of the blower unit 6 on the basis of the signal output from the hand detection sensor 11 to allow the high speed airflows to jet from the hand dryer nozzles 3*a* and 3*b* into the hand drying portion 3. As illustrated in FIG. 3, the control unit 12 includes a sensor control unit 21, the hand detection determination unit 22, an operation control unit 23, and a basic operation control unit 24. FIG. 3 is a functional block diagram of main parts of the hand dryer device 1 according to the embodiment of the present invention.

The sensor control unit 21 controls an intermittent driving of the hand detection sensor 11. The hand detection determination unit 22 makes a hand detection determination of whether the hand is present or absent in the hand drying portion 3 on the basis of a detection result of the hand detection sensor 11. The operation control unit 23 controls the driving of the blower unit 6 in accordance with stop instruction signal or an operation instruction signal output from the hand detection determination unit 22. The stop instruction signal instructs the blower unit 6 to stop. The operation instruction signal instructs the blower unit 6 to operate. The basic operation control unit 24 controls general operations of the control units in the control unit 12, and the components of the hand dryer device 1. The control units in the control unit 12 can communicate information with one another.

Figure 4:
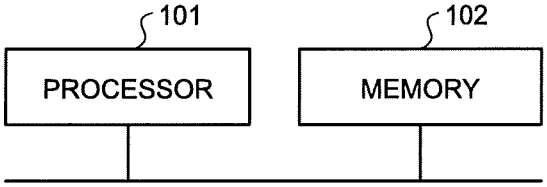
FIG. 4 is a diagram illustrating an example of a hardware configuration of a processing circuit according to the embodiment of the present invention.

The sensor control unit 21 is implemented, for example, as a processing circuit having a hardware configuration illustrated in FIG. 4. FIG. 4 is a diagram illustrating an example of the hardware configuration of the processing circuit. Each of the components of the sensor control unit 21 is implemented by, for example, a processor 101 of FIG. 4 executing a program stored in a memory 102. The above functions may be implemented by cooperation of plural processors with plural memories. Alternatively, a part of the functions of the sensor control unit 21 may be implemented as an electronic circuit, and the other parts may be implemented using the processor 101 and the memory 102. In addition, at least one of the operation control unit 23 and the basic operation control unit 24 may be configured to be implemented by the processor 101 executing the program stored in the memory 102 in the similar manner. The processor and the memory for implementing at least one of the operation control unit 23 and the basic operation control unit 24 may be identical to those that implement the sensor control unit 21, or may be other processor and other memory.

A description is made next as to the control unit 12 controlling the intermittent driving of the hand detection sensor 11. The hand detection sensor 11 is controlled to be driven or stop in accordance with a sensor driving instruction signal or a sensor stop instruction signal output from the sensor control unit 21. The sensor driving instruction signal instructs the hand detection sensor 11 to be driven. The sensor stop instruction signal instructs the hand detection sensor 11 to stop. The hand detection sensor 11 outputs, to the hand detection determination unit 22, the hand detection signal providing a detection result indicative of whether or not an insertion of the user's hand has been detected in the hand drying portion 3. The hand detection sensor 11 outputs a high-level signal or a low-level signal as the hand detection signal. The hand detection sensor 11 outputs the high-level signal when the hand has been detected, and the low-level signal when the hand is not detected.

The hand detection determination unit 22 processes the hand detection signal output from the hand detection sensor 11, and makes a hand detection determination to determine whether the hand is present or absent in the hand drying portion 3. When the hand detection signal is the high-level signal, the hand detection determination unit 22 determines that "the hand is present in the hand drying portion 3." When the hand detection signal is the low-level signal, the hand detection determination unit 22 determines that "the hand is absent in the hand drying portion 3." The expression "the hand is present in the hand drying portion 3" may hereinafter be simply described as "hand present," while the expression "the hand is absent in the hand drying portion 3" may hereinafter be simply described as "hand absent."

Figure 5:
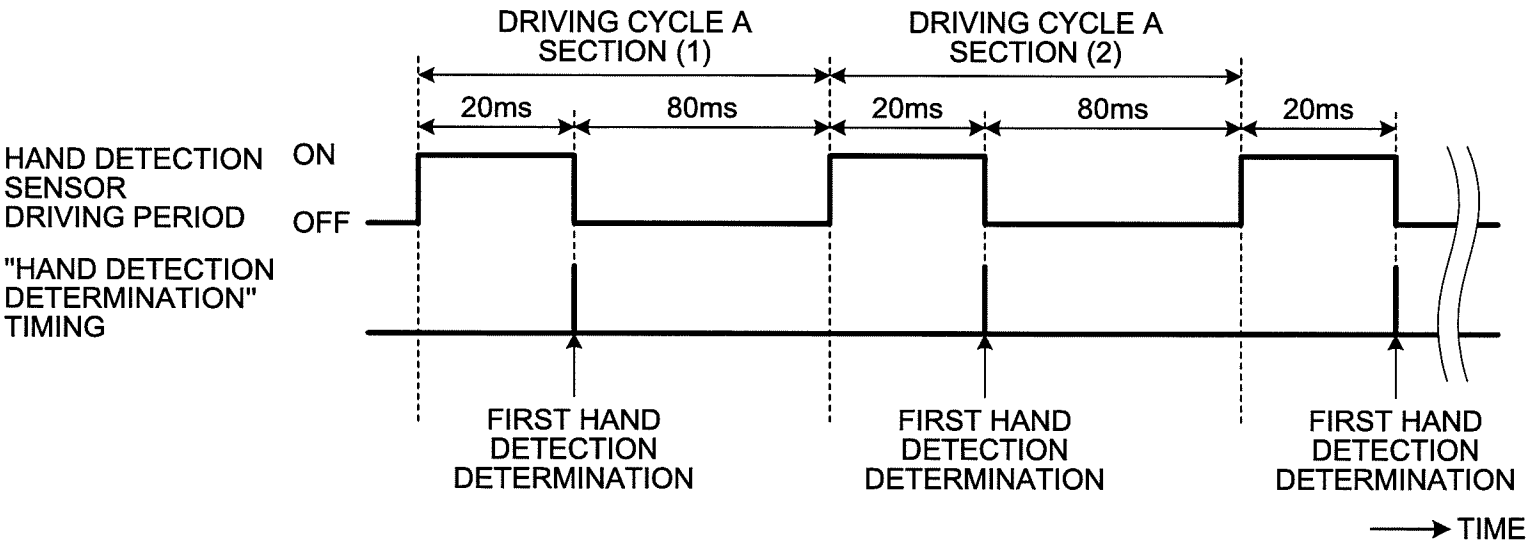
FIG. 5 is a timing chart illustrating a timing relationship between an intermittent driving of a hand detection sensor and a hand detection determination in "driving cycle A" in the hand dryer device according to the embodiment of the present invention.
Figure 6:
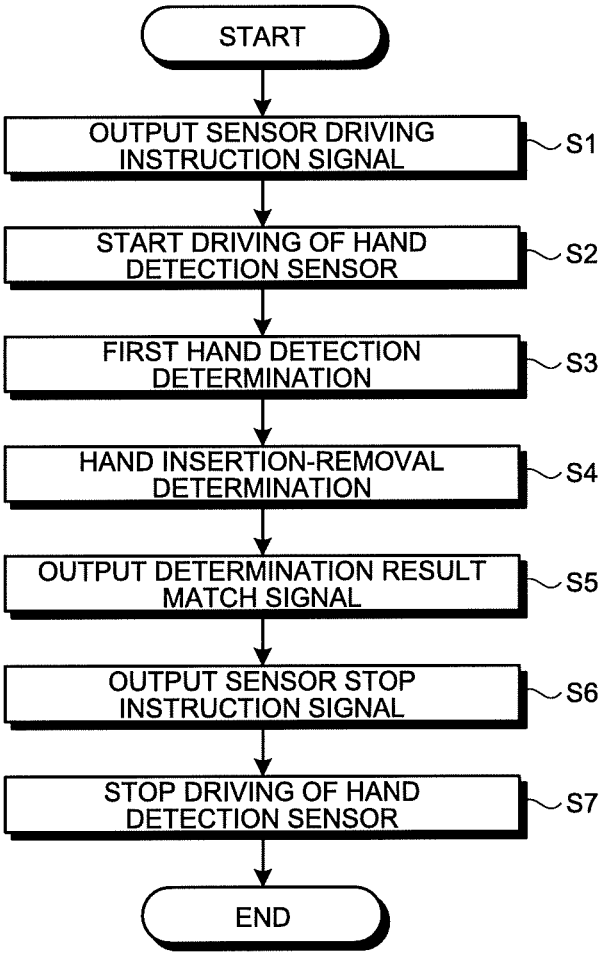
FIG. 6 is a flowchart illustrating a process of an intermittent driving of the hand detection sensor in "driving cycle A" in the hand dryer device according to the embodiment of the present invention.
Figure 7:
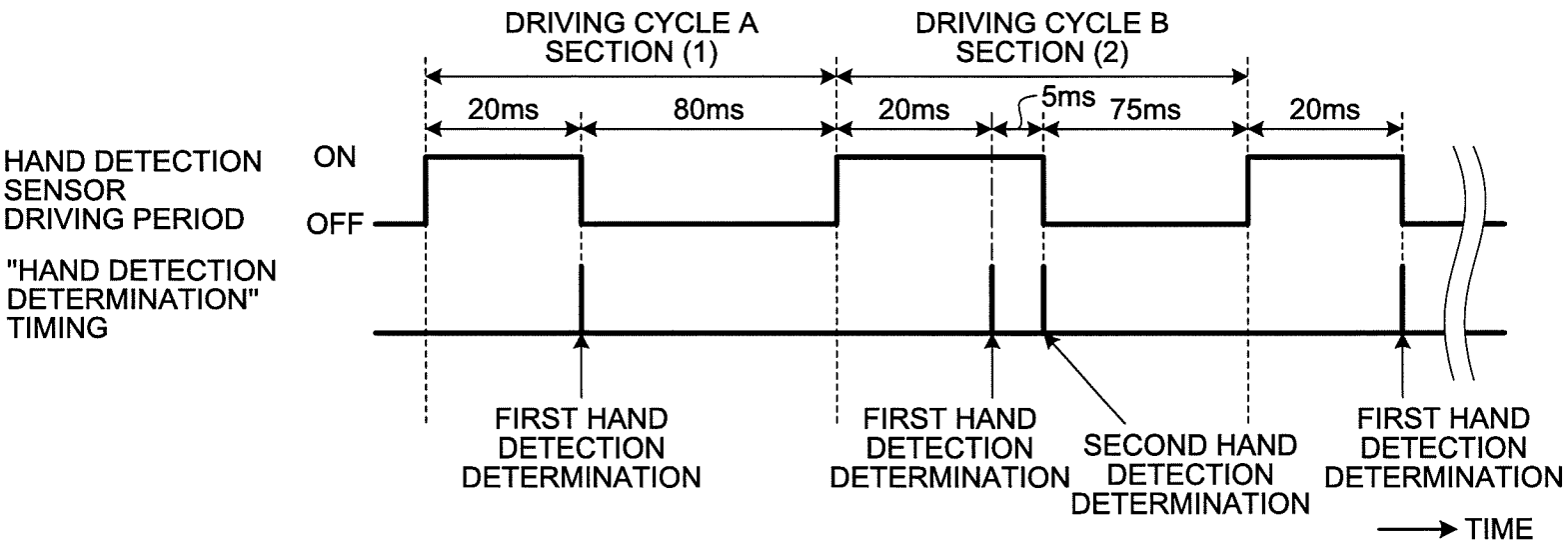
FIG. 7 is a timing chart illustrating a timing relationship between an intermittent driving of the hand detection sensor and a hand detection determination in "driving cycle B" in the hand dryer device according to the embodiment of the present invention.
Figure 8:
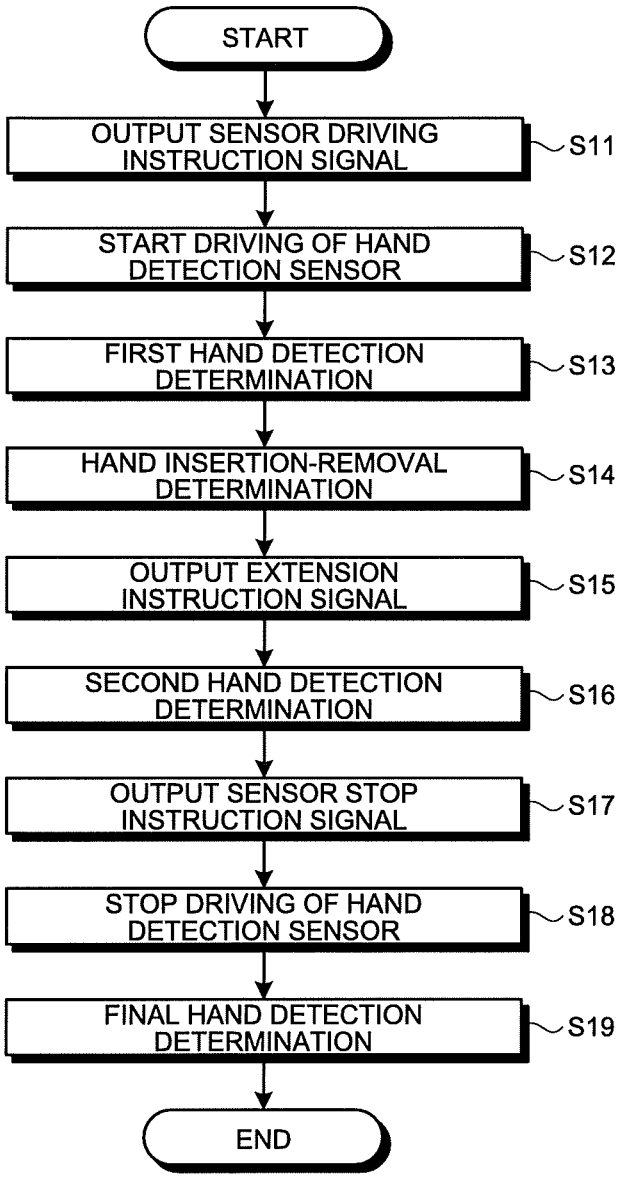
FIG. 8 is a flowchart illustrating a process of an intermittent driving of the hand detection sensor in "driving cycle B" in the hand dryer device according to the embodiment of the present invention.

FIG. 5 is a timing chart illustrating a timing relationship between the intermittent driving of the hand detection sensor 11 and the hand detection determination in "driving cycle A" in the hand dryer device 1 according to the embodiment of the present invention. FIG. 6 is a flowchart illustrating a process of the intermittent driving of the hand detection sensor 11 in "driving cycle A" in the hand dryer device 1 according to the embodiment of the present invention. FIG. 7 is a timing chart illustrating a timing relationship between the intermittent driving of the hand detection sensor 11 and the hand detection determination in "driving cycle B" in the hand dryer device 1 according to the embodiment of the present invention. FIG. 8 is flowchart illustrating a process of the intermittent driving of the hand detection sensor 11 in "driving cycle B" in the hand dryer device 1 according to the embodiment of the present invention.

In FIGS. 5 and 7, the horizontal axis represents the time. In the timing charts of FIGS. 5 and 7, "ON" represents a situation in which the light-emitting element of the hand detection sensor 11 is emitting light, while "OFF" represents a situation in which the light-emitting element of the hand detection sensor 11 is not emitting light. A driving period of the hand detection sensor 11 is a time period in which the light-emitting element of the hand detection sensor 11 is driven to emit light. The timing of a hand detection determination is a timing at which the hand detection determination unit 22 makes a determination that is "hand present" or "hand absent" on the basis of the hand detection signal output from the hand detection sensor 11 during one predefined driving cycle of the hand detection sensor 11. The period of a driving cycle of the hand detection sensor 11 is herein assumed to be 100 ms. The predefined active period of the hand detection sensor 11 is herein assumed to be 20 ms. The vertical lines shown in "hand detection determination timing" of FIGS. 5 and 7 each represent a timing at which to make a hand detection determination.

An example of control of the intermittent driving of the hand detection sensor 11 on the basis of "driving cycle A"

illustrated in FIG. 5 will first be described with reference to the flowchart of FIG. 6. At the beginning of the driving cycle of the hand detection sensor 11, at step S1, the sensor control unit 21 outputs, to the hand detection sensor 11, the sensor driving instruction signal instructing the hand detection sensor 11 to be driven.

At step S2, the hand detection sensor 11 starts to be driven in accordance with the sensor driving instruction signal. The hand detection sensor 11 then outputs a high-level signal or a low-level signal to the hand detection determination unit 22 as the hand detection signal.

When the predefined driving period of the hand detection sensor 11, which is 20 ms, has elapsed, that is, when 20 ms has elapsed since the start of driving of the hand detection sensor 11, the hand detection determination unit 22 makes, at step S3, a "first hand detection determination" in the section (1) that is a first driving cycle. That is, the hand detection determination unit 22 makes a determination that is "hand present" or "hand absent" on the basis of the high-level signal or the low-level signal output from the hand detection sensor 11.

At step S4, the hand detection determination unit 22 makes a comparison between a determination result of "first hand detection determination" in the section (1) and a hand detection determination result in a driving cycle located one cycle before the section (1) to thereby make a "hand insertion-removal determination," and thus determines whether "a hand has been inserted and removed." When the determination result of "first hand detection determination" in the section (1) matches the hand detection determination result in the driving cycle located one cycle before the section (1), the hand detection determination unit 22 outputs, at step S5, to the sensor control unit 21, a determination result matching signal indicating that it is not determined that "the hand has been inserted and removed." Since the process in "driving cycle A" is an example of control in which it is not determined that "the hand has been inserted and removed," the hand detection determination unit 22 outputs, to the sensor control unit 21, a determination result matching signal indicating that it is not determined that "the hand has been inserted and removed."

The case in which the determination result of the hand detection determination unit 22 in "first hand detection determination" in the section (1) matches the hand detection determination result in the driving cycle located one cycle before the section (1) is a case in which it is not determined that "a hand has been inserted during stop of the blower unit 6," or that "the hand has been removed during operation of the blower unit 6."

It is not determined that "the hand has been inserted during the stop of the blower unit 6" when the determination result provided by the hand detection determination unit 22 is "hand absent" during the stop of the blower unit 6 in the cycle located one cycle before the section (1) while the determination result provided by the hand detection determination unit 22 is "hand absent" during the stop of the blower unit 6 in the section (1). In addition, it is not determined that "the hand has been removed during the operation of the blower unit 6" when the determination result provided by the hand detection determination unit 22 is "hand present" during the operation of the blower unit 6 in the cycle located one cycle before the section (1) while the determination result provided by the hand detection determination unit 22 is "hand present" during the operation of the blower unit 6 in the section (1).

Note that the hand detection determination unit 22 stores the hand detection determination results and operational states of the blower unit 6 in previous cycles in a storage unit within the hand detection determination unit 22 or in other storage unit within the control unit 12.

The hand detection determination result in the section (1) is set as follows. The hand detection determination unit 22 processes "first hand detection determination" in one driving cycle to determine a final "hand detection determination result" in such one driving cycle as follows. When "first hand detection determination" is "hand present", the final "hand detection determination result" is "hand present." When "first hand detection determination" is "hand absent", the final "hand detection determination result" is "hand absent." Such decision criteria are previously stored in a storage unit in the hand detection determination unit 22 or in other storage unit in the control unit 12.

At step S6, the sensor control unit 21 outputs a sensor stop instruction signal to the hand detection sensor 11 on the basis of the determination result matching signal, thereby performing control to stop the hand detection sensor 11 for the remaining time period of 80 ms in one predefined cycle time of 100 ms. At step S7, the hand detection sensor 11 stops in accordance with the sensor stop instruction signal. That is, the hand detection sensor 11 is driven only for the time period of first 20 ms in one predefined cycle time of 100 ms.

The method for driving the hand detection sensor 11 described above is herein referred to as "driving cycle A" in which the hand detection determination result in the previous one of two consecutive driving cycles matches the first hand detection determination result in the other current driving cycle. The sensor control unit 21 intermittently drives the hand detection sensor 11 basically in "driving cycle A."

Also in the section (2) and the subsequent sections, the hand detection determination unit 22 and the sensor control unit 21 intermittently drive the hand detection sensor 11 in "driving cycle A", when the hand detection determination result in the previous one of two consecutive driving cycles matches the first hand detection determination result in the other current driving cycle.

The intermittent driving of the hand detection sensor 11 in "driving cycle A" as described above can reduce the power consumption of the hand detection sensor 11 to 20/100 as compared to the case where the hand detection sensor 11 is continuously driven. Thus, the hand dryer device 1 can reduce the power consumption of the hand detection sensor 11 and hence the overall power consumption of the hand dryer device 1.

It is assumed herein that the infrared distance measurement sensor in the present embodiment needs a time period of 15 ms to stabilize the intensity of light emitted from the light-emitting element after the hand detection sensor 11 is driven to cause the light-emitting element to start to emit light, and the hand detection determination unit 22 needs a time period of 5 ms to make the hand detection determination based on the hand detection signal from the hand detection sensor 11. Therefore, the above description is based on the assumption that a time period taken from the start of driving of the hand detection sensor 11 to the hand detection determination of the hand detection determination unit 22 is set to a minimum time period of 20 ms.

An example of control of the intermittent driving of the hand detection sensor 11 on the basis of "driving cycle B" illustrated in FIG. 7 will next be described with reference to the flowchart of FIG. 8. This example assumes that "first hand detection determination" in the section (1) matches the final "hand detection determination result" in the driving cycle located one cycle before the section (1), that is, it is not determined that "a hand has been inserted during stop of the blower unit 6," or "the hand has been removed during operation of the blower unit 6."

This example also assumes that "first hand detection determination" in the section (2) provides a result different from the final "hand detection determination result" in the section (1) that is the driving cycle located one cycle before the section (2).

This means that it is determined that "the hand has been inserted during the stop of the blower unit 6," or "the hand has been removed during the operation of the blower unit 6."

In "driving cycle B," the final "hand detection determination result" in the section (2), which is determined from the result of "first hand detection determination" and the result of "second hand detection determination" in the section (2), is set as follows.

It is determined that "the hand has been inserted during the stop of the blower unit 6" when the determination result provided by the hand detection determination unit 22 is "hand absent" during the stop of the blower unit 6 in the section (1) while the determination result provided by the hand detection determination unit 22 is "hand present" during the stop of the blower unit 6 in the section (2). In addition, it is determined that "the hand has been removed during the operation of the blower unit 6" when the determination result provided by the hand detection determination unit 22 is "hand present" during the operation of the blower unit 6 in the section (1) while the determination result provided by the hand detection determination unit 22 is "hand absent" during the operation of the blower unit 6 in the section (2).

The hand detection sensor 11 is intermittently driven under control of the above-mentioned "driving cycle A" in the section (1). In the section (2), the sensor control unit 21 first outputs a sensor driving instruction signal to the hand detection sensor 11 at step S11 similarly to the process in "driving cycle A." At step S12, the hand detection sensor 11 starts to be driven in accordance with the sensor driving instruction signal. The hand detection sensor 11 then outputs a high-level signal or a low-level signal to the hand detection determination unit 22 as the hand detection signal.

When 20 ms has elapsed since the start of driving of the hand detection sensor 11, the hand detection determination unit 22 makes, at step S13, "first hand detection determination" in the section (2). That is, the hand detection determination unit 22 makes a determination that is "hand present" or "hand absent" on the basis of the high-level signal or the low-level signal output from the hand detection sensor 11.

At step S14, the hand detection determination unit 22 makes a comparison between a final "hand detection determination result" in the section (1), which is the cycle located one cycle before the section (2), and the result of "first hand detection determination" in the section (2) to thereby make "hand insertion-removal determination," and thus determines whether "a hand has been inserted and removed." When the determination result of "first hand detection determination" in the section (2) differs from the final "hand detection determination result" in the section (1), the hand detection determination unit 22 determines that "the hand has been inserted and removed," and thus outputs, at step S15, to the sensor control unit 21, an extension instruction signal providing an instruction to extend the driving period of the hand detection sensor 11. Because, in this example of the control discussed above, the result of "first hand detection determination" in the section (2) differs from the final "hand detection determination result" in the section (1) that is the driving cycle located one cycle before the section (2), the hand detection determination unit 22 outputs, to the sensor control unit 21, the extension instruction signal providing the instruction to extend the driving period of the hand detection sensor 11.

The case in which the result of "first hand detection determination" in the section (2) differs from the final "hand detection determination result" in the section (1) is a case in which it is determined that "the hand has been inserted during the stop of the blower unit 6," or "the hand has been removed during the operation of the blower unit 6."

Note that the hand detection determination unit 22 stores the final "hand detection determination result" and operational states of the blower unit 6 in the section (1) in a storage unit within the hand detection determination unit 22 or in other storage unit within the control unit 12.

On the basis of the extension instruction signal, the sensor control unit 21 performs processing to extend the driving period of the hand detection sensor 11 by 5 ms that is a predefined driving extension time period of the hand detection sensor 11. That is, the sensor control unit 21 increases the duty ratio at which to drive the hand detection sensor 11 in one driving cycle time of 100 ms. The driving extension time period is the time period of extension of the driving of the hand detection sensor 11. That is, at this point of time, the sensor control unit 21 outputs no sensor stop instruction signal to the hand detection sensor 11, and thus, does not perform control to stop the driving of the hand detection sensor 11.

When the driving extension time period has elapsed, that is, when 25 ms has elapsed since the start of driving of the hand detection sensor 11, the hand detection determination unit 22 makes, at step S16, a "second hand detection determination" in the section (2). At step S17, the sensor control unit 21 outputs a sensor stop instruction signal to the hand detection sensor 11, and performs control to stop the hand detection sensor 11 for the remaining time period of 75 ms in one driving cycle time of 100 ms. At step S18, the hand detection sensor 11 stops in accordance with the sensor stop instruction signal. That is, the hand detection sensor 11 is driven only for the time period of first 25 ms in one driving cycle time of 100 ms.

The method for operating the hand detection sensor 11 in the section (2) as described above is herein referred to as "driving cycle B" in which the hand detection determination result in the previous one of two consecutive driving cycles differs from the first hand detection determination result in the other current driving cycle.

In the case of "driving cycle B," the hand detection determination unit 22 makes a comparison, at step S19, between "first hand detection determination" and "second hand detection determination" to thereby make a final hand detection determination, and thus determines the final "hand detection determination result" in the section (2). Determining the final "hand detection determination result" by comparing "first hand detection determination" with "second hand detection determination" in "driving cycle B" as described above can reduce or prevent false detection of the hand detection result due to noise, and can thus reduce or prevent noise-induced malfunction of the blower unit 6. Such mechanism can improve the hand detection accuracy and the precision in operation of the blower unit 6 of the hand dryer device 1.

The hand detection determination unit 22 determines the final "hand detection determination result" in the section (2) on the basis of the below decision criteria of the final hand detection determination in one driving cycle. The decision criteria of the final hand detection determination are previously stored in a storage unit within the hand detection determination unit 22 or in other storage unit within the control unit 12.

When "first hand detection determination" is "hand present" and "second hand detection determination" is "hand present," the final "hand detection determination result" is "hand present."

When "first hand detection determination" is "hand absent" and "second hand detection determination" is "hand absent", the final "hand detection determination result" is "hand absent."

When "first hand detection determination" provides is "hand present" and "second hand detection determination" provides is "hand absent", the final "hand detection determination result" is "hand absent."

When "first hand detection determination" is "hand absent" and "second hand detection determination" is "hand present", the final "hand detection determination result" is "hand present."

To control the driving of the hand detection sensor 11 after the section (2) again in "driving cycle A," which is the standard cycle, the sensor control unit 21 generally resets the driving period of the hand detection sensor 11 to the pre-extension driving period after the section (2) terminates. That is, the sensor control unit 21 controls the driving of the hand detection sensor 11 basically in "driving cycle A," and when the hand detection determination result of "first hand detection determination" in a certain driving cycle differs from the final "hand detection determination result" in the cycle located one cycle before this driving cycle, the sensor control unit 21 controls the driving of the hand detection sensor 11 in "driving cycle B" during this driving cycle. In the next driving cycle, the driving period of the hand detection sensor 11 is reset to the predefined driving period. It is thus unlikely that the driving period of the hand detection sensor 11 is subsequently set to be extended for a certain period of time thereafter even in the absence of the detection of the hand. As a result, a next hand detection determination does not require a longer time.

Thus, when it is not determined that the hand has been inserted during the stop of the blower unit 6, or the hand has been removed during the operation of the blower unit 6, at "first hand detection determination" in the driving cycle next to the section (2), the sensor control unit 21 continues to control the driving of the hand detection sensor 11 in "driving cycle A."

In "driving cycle B," the hand detection sensor 11 starts to be driven operation, and then makes "first hand detection determination," followed by "second hand detection determination" in that driving cycle. Accordingly, the "second hand detection determination" in "driving cycle B" does not require a time period of 15 ms, which is required to stabilize the intensity of emitted light after the hand detection sensor 11 is driven to cause the light-emitting element start to emit light. Rather, the "second hand detection determination" only requires a time period of 5 ms after "first hand detection determination."

That is, the power consumption during intermittent driving of the hand detection sensor 11 in "driving cycle B" can be reduced to 25/100, instead of 40/100, which is twice the power consumption during intermittent driving in "driving cycle A," as compared to a case in which the hand detection sensor 11 is continuously driven.

Note that the predefined driving period of the hand detection sensor 11, the timing at which the hand detection determination unit 22 makes the hand detection determination, the driving extension time period, the number of driving extensions representing how many times the driving of the hand detection sensor 11 is extended, and the number of the hand detection determinations representing how many times the hand detection determination unit 22 makes the hand detection determinations, are not limited to the values used in the example described above, and may each be set to any value.

Although the present embodiment assumes that the timing at which the hand detection sensor 11 extends the driving period comes after "first hand detection determination," the timing at which to extend the driving of the hand detection sensor 11 may come after "second hand detection determination" such that both "first hand detection determination" and "second hand detection determination" are always made.

Figure 9:
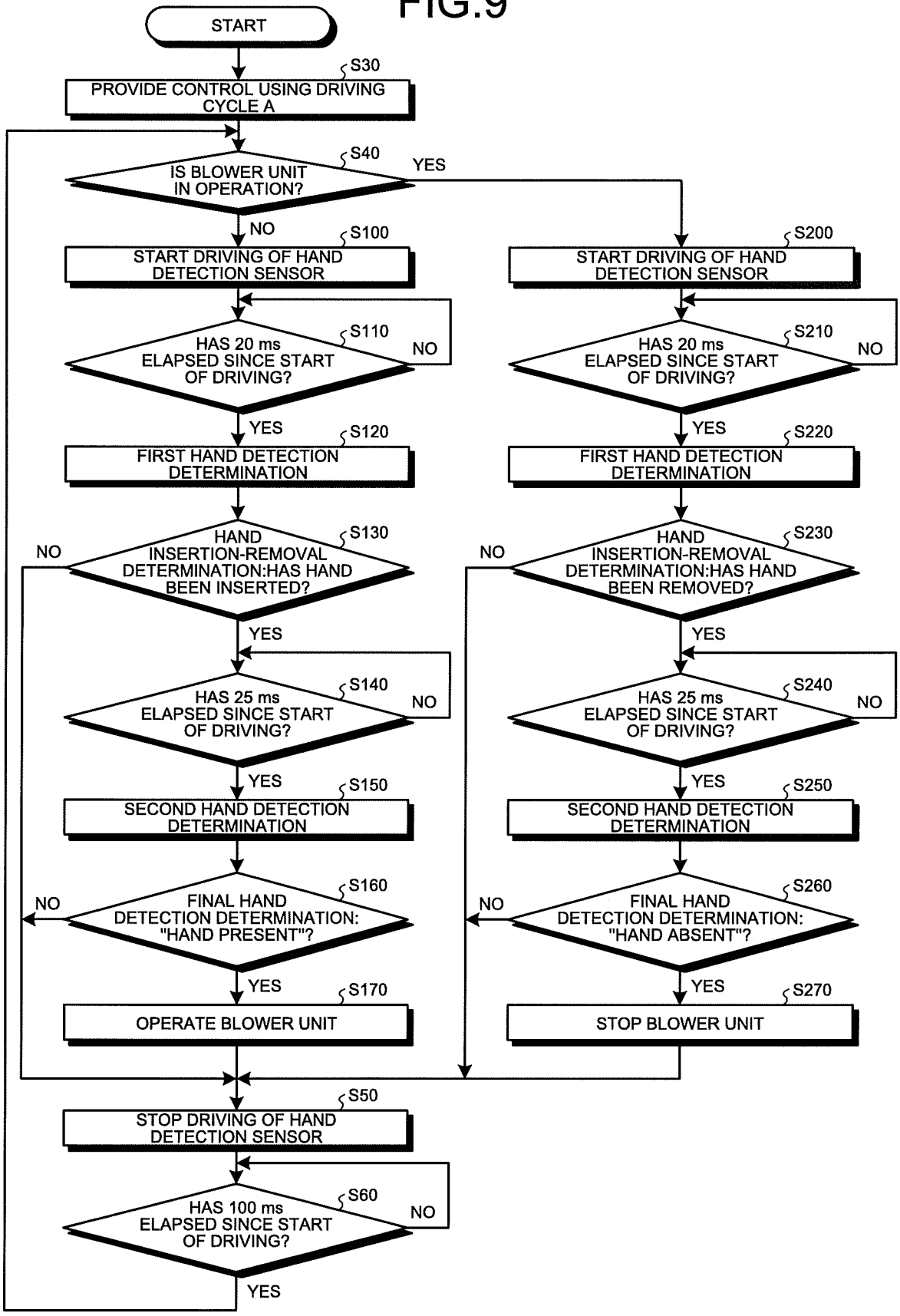
FIG. 9 is a flowchart illustrating a process of control of operation of the hand dryer device provided by the control unit according to the embodiment of the present invention.

An example of the operation of the hand dryer device 1 will next be described. FIG. 9 is a flowchart illustrating a process of control of operation of the hand dryer device 1 provided by the control unit 12 according to the embodiment of the present invention. The description below is focused mainly on "driving cycle B," which characterizes the control provided by the control unit 12, and assumes that the start of driving at step S40 corresponds to the start of driving in "driving cycle B" of the section (2) in the timing chart of FIG. 7.

When the hand dryer device 1 is powered on, the hand dryer device 1 transitions to a standby state. That is, the blower unit 6 stops, the hand detection sensor 11 is in a standby state, and "hand detection determination" of the hand detection sensor 11 is "hand absent," which is the initial value.

Next, at step S30, the control unit 12 repeatedly performs driving control on the hand detection sensor 11 in "driving cycle A" described above. This "driving cycle A", which corresponds to the section (1) in the timing chart of FIG. 7, is also hereinafter referred to as section (1). When a final "hand detection determination result" output from the hand detection determination unit 22 is "hand present" during the control on the hand detection sensor 11 in "driving cycle A", the operation control unit 23 outputs, to the blower unit 6, an operation instruction signal instructing the blower unit 6 to operate, on the basis of "hand detection determination result" that is "hand present." The blower unit 6 then starts operation in accordance with the operation instruction signal.

Alternatively, when a final "hand detection determination result" output from the hand detection determination unit 22 is "hand absent" during the control on the hand detection sensor 11 in "driving cycle A", the operation control unit 23 outputs, to the blower unit 6, a stop instruction signal instructing the blower unit 6 to stop, on the basis of "hand detection determination result" that is "hand absent." The blower unit 6 stops operation in accordance with the stop instruction signal. This example assumes that the operational state of the blower unit 6 after step S30 may be either an operative state or a stop state.

Next, at step S40, a new driving cycle starts, and the operation control unit 23 determines the operational state of the blower unit 6. Note that also during the driving control on the hand detection sensor 11 in "driving cycle A" at step S30, the operation control unit 23 determines the operational state of the blower unit 6 at the beginning of a new driving cycle. This new driving cycle, which is "driving cycle B" described above and corresponds to the section (2) in the timing chart of FIG. 7, is also hereinafter referred to as section (2). The blower unit 6 constantly outputs, to the operation control unit 23, a blower unit operative signal indicating that the blower unit 6 is in operation, or a blower unit stop signal indicating that the blower unit 6 stops. The operation control unit 23 determines the operational state of the blower unit 6 using the blower unit operative signal or the blower unit stop signal output from the blower unit 6, and then outputs a result of such determination to the hand detection determination unit 22.

When the blower unit 6 is outputting the blower unit operative signal, the operation control unit 23 determines that the blower unit 6 is in an operative state, and thus outputs a blower unit operative state signal indicating that the blower unit 6 is in operation, to the sensor control unit 21 and to the hand detection determination unit 22. When the blower unit 6 is outputting the blower unit stop signal, the operation control unit 23 determines that the blower unit 6 is in a stop state, and thus outputs a blower unit stop state signal indicating that the blower unit 6 stops, to the sensor control unit 21 and to the hand detection determination unit 22. When the blower unit 6 is in the stop state (i.e., "No" at step S40), the process proceeds to step S100. When the blower unit 6 is in the operative state (i.e., "Yes" at step S40), the process proceeds to step S200. Note that because the blower unit 6 is in the stop state when the process proceeds to step S100, "hand detection determination result" after step S30 should be "hand absent." Note that because the blower unit 6 is in the operative state when the process proceeds to step S200, "hand detection determination result" after step S30 should be "hand present."

At step S100, the sensor control unit 21 outputs a sensor driving instruction signal to the hand detection sensor 11. The hand detection sensor 11 starts to be driven in accordance with the sensor driving instruction signal.

Next, at step S110, the hand detection determination unit 22 uses its timer function to determine whether 20 ms that is the predefined driving period of the hand detection sensor 11 has elapsed since the start of driving of the hand detection sensor 11. When 20 ms has not yet elapsed since the start of driving of the hand detection sensor 11 (i.e., "No" at step S110), the process returns to step S110. When 20 ms has elapsed since the start of driving of the hand detection sensor 11 (i.e., "Yes" at step S110), on the other hand, the process proceeds to step S120.

Next, at step S120, when 20 ms has elapsed since the start of driving of the hand detection sensor 11, the hand detection determination unit 22 makes "first hand detection determination" in the section (2) to make a determination that is "hand present" or "hand absent".

Next, at step S130, the hand detection determination unit 22 makes "hand insertion-removal determination" to determine whether "a hand has been inserted during stop of the blower unit 6." That is, the hand detection determination unit 22 determines whether the final "hand detection determination result" in the section (1) differs from "first hand detection determination result" in the section (2).

When it is determined that "the hand has been inserted during the stop of the blower unit 6" (i.e., "Yes" at step S130, and "first hand detection determination result" in the section (2) is "hand present"), the hand detection determination unit 22 outputs, to the sensor control unit 21, an extension instruction signal providing an instruction to extend the driving period of the hand detection sensor 11 by a time period of 5 ms, and the process proceeds to step S140. On the basis of the extension instruction signal, the sensor control unit 21 performs processing to extend the driving period by 5 ms that is the predefined driving extension time period. In this regard, when the final "hand detection determination result" in the section (1) is "hand absent," and "first hand detection determination result" in the section (2) is "hand present," the hand detection determination unit 22 determines that "the hand has been inserted during the stop of the blower unit 6."

When it is not determined that "the hand has been inserted during the stop of the blower unit 6" (i.e., "No" at step S130), the hand detection determination unit 22 outputs a sensor stop instruction signal to the hand detection sensor 11, and the process proceeds to step S50. In this regard, when the final "hand detection determination result" in the section (1) is "hand absent," and "first hand detection determination result" in the section (2) is "hand absent," the hand detection determination unit 22 does not determine that "the hand has been inserted during the stop of the blower unit 6."

Figure 10:
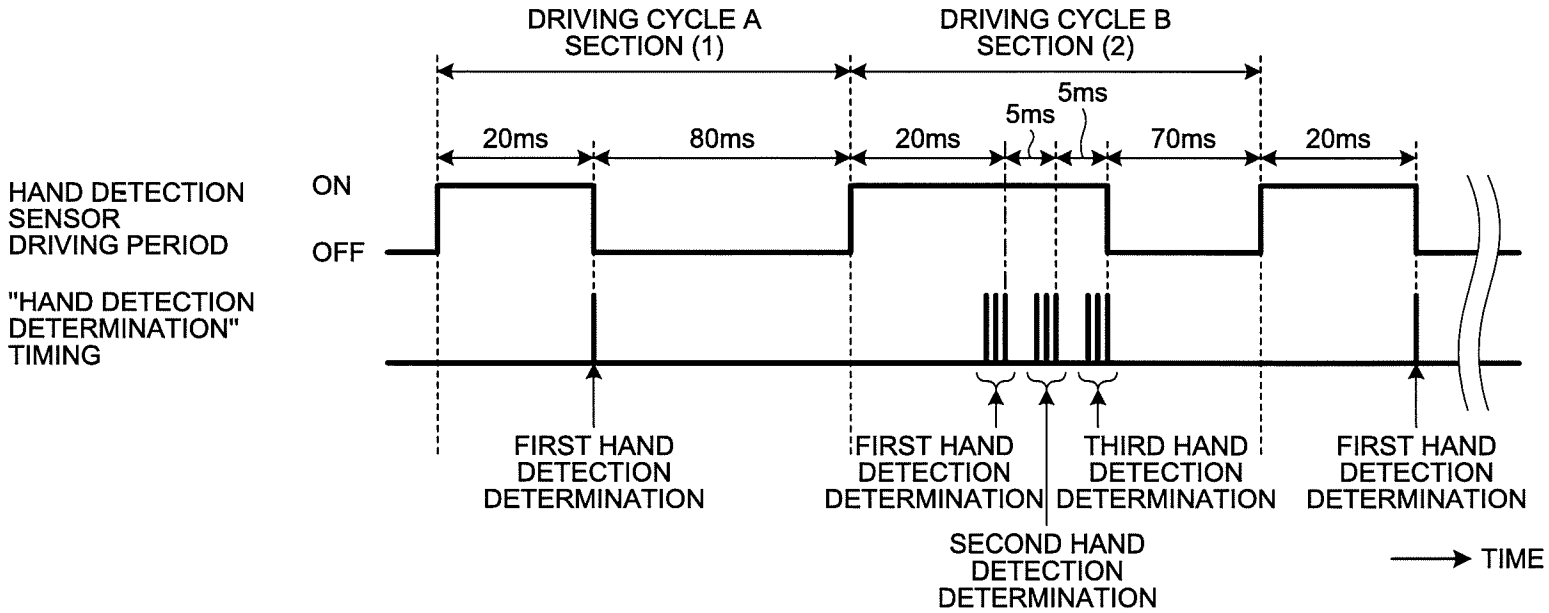
FIG. 10 is a timing chart illustrating a timing relationship between an intermittent driving of the hand detection sensor and a hand detection determination in "driving cycle B" when a final "hand detection determination result" in one driving cycle is determined by using a majority decision among hand detection determination results in the hand dryer device according to the embodiment of the present invention.

Although the present embodiment assumes that the number of times of the hand detection determinations is up to two in "driving cycle B", the number of times of the hand detection determinations is not limited to two, but may also be three, four, or more. When the hand detection determination is made three or more times, the final "hand detection determination result" in one driving cycle may be determined by using a majority decision among the hand detection determination results. FIG. 10 is a timing chart illustrating a timing relationship between an intermittent driving of the hand detection sensor 11 and the hand detection determination in "driving cycle B" when the final "hand detection determination result" in one driving cycle is determined by using a majority decision among hand detection determination results in the hand dryer device 1 according to the embodiment of the present invention. The example illustrated in FIG. 10 determines the final "hand detection determination result" in one driving cycle by using a majority decision among three hand detection determination results. In addition, each of the "first hand detection determination" in the section (2), the "second hand detection determination" in the section (2), and the "third hand detection determination" in the section (2) is made by checking the hand detection signal consecutively three times.

When the hand detection determination unit 22 determines the final "hand detection determination result" in one driving cycle by using a majority decision among hand detection determination results, the hand detection determination unit 22 may forgo hand detection determinations without extension of the driving period of the hand detection sensor 11 after the majority decision is finalized by the smaller number of times of the hand detection determinations than the preset number of times of the hand detection determinations. For example, a majority decision is performed each time a hand detection determination is made, and when the majority decision fails to be finalized, the driving period of the hand detection sensor 11 is extended to make another hand detection determination. Where the number of times of the hand detection determinations is set to five, the driving period of the hand detection sensor 11 is extended upon each determination for the hand detection sensor 11. When the majority decision is then finalized before the number of times of the hand detection determinations reach five, the driving period of the hand detection sensor 11 is no longer extended, and a determination for the hand detection sensor 11 is no more made. Thus, increasing the number of times of the hand detection determinations in "driving cycle B" to three, four, or more can further reduce malfunction of the blower unit 6 due to noise.

At step S140, the hand detection determination unit 22 determines whether 25 ms has elapsed, which is a sum of the predefined driving period of 20 ms and the predefined driving extension time period of 5 ms, since the start of driving of the hand detection sensor 11. When 25 ms has not yet elapsed (i.e., "No" at step S140), the process returns to step S140. When 25 ms has elapsed (i.e., "Yes" at step S140), on the other hand, the process proceeds to step S150.

At step S150, when the driving extension time period has elapsed, that is, when 25 ms has elapsed since the start of driving of the hand detection sensor 11, the hand detection determination unit 22 makes the "second hand detection determination" in the section (2) to make a determination that is "hand present" or "hand absent". Then, at step S150, the hand detection determination unit 22 outputs a sensor stop instruction signal to the hand detection sensor 11.

Next, at step S160, the hand detection determination unit 22 makes a comparison between "first hand detection determination" and "second hand detection determination" in the section (2) to make a final hand detection determination, and thus determines the final "hand detection determination result" in the section (2). The hand detection determination unit 22 then determines whether the final "hand detection determination result" in the section (2) is "hand present."

When the final "hand detection determination result" in the section (2) is "hand present" (i.e., "Yes" at step S160), the hand detection determination unit 22 determines that "the hand has been inserted during the stop of the blower unit 6" and the process proceeds to step S170. At step S170, the hand detection determination unit 22 outputs an operation instruction signal to the blower unit 6, and the blower unit 6 then starts operation in accordance with the operation instruction signal.

When the final "hand detection determination result" in the section (2) is not "hand present" (i.e., "No" at step S160), on the other hand, the hand detection determination unit 22 does not determine that "the hand has been inserted during the stop of the blower unit 6," and the process proceeds to step S50. Then, at step S50, the hand detection sensor 11 stops in accordance with the sensor stop instruction signal.

Next, at step S60, the operation control unit 23 determines whether 100 ms has elapsed, which is one driving cycle time, since the start of driving of the hand detection sensor 11. When 100 ms has not yet elapsed since the start of driving of the hand detection sensor 11 (i.e., "No" at step S60), the process returns to step S60. When 100 ms has elapsed since the start of driving of the hand detection sensor 11 (i.e., "Yes" at step S60), the process returns to step S40.

Moreover, at step S200, the sensor control unit 21 outputs a sensor driving instruction signal to the hand detection sensor 11. The hand detection sensor 11 then starts operation in accordance with the sensor driving instruction signal.

Next, at step S210, the hand detection determination unit 22 uses its timer function to determine whether 20 ms that is the predefined driving period of the hand detection sensor 11 has elapsed since the start of driving of the hand detection sensor 11. When 20 ms has not yet elapsed since the start of driving of the hand detection sensor 11 (i.e., "No" at step S210), the process returns to step S210. When 20 ms has elapsed since the start of driving of the hand detection sensor 11 (i.e., "Yes" at step S210), on the other hand, the process proceeds to step S220.

Next, at step S220, when 20 ms has elapsed since the start of driving of the hand detection sensor 11, the hand detection determination unit 22 makes "first hand detection determination" in the section (2) to make a determination that is "hand present" or "hand absent".

Next, at step S230, the hand detection determination unit 22 makes "hand insertion-removal determination" to determine whether "the hand has been removed during operation of the blower unit 6." That is, the hand detection determination unit 22 determines whether the final "hand detection determination result" in the section (1) and "first hand detection determination result" in the section (2) differ from each other.

When it is determined that "the hand has been removed during the operation of the blower unit 6" (i.e., "Yes" at step S230, and "first hand detection determination result" in the section (2) is "hand absent"), the hand detection determination unit 22 outputs, to the sensor control unit 21, an extension instruction signal providing an instruction to extend the driving period of the hand detection sensor 11 by a time period of 5 ms, and the process proceeds to step S240. On the basis of the extension instruction signal, the sensor control unit 21 performs processing to extend the driving period by 5 ms that is the predefined driving extension time period. In this regard, when the final "hand detection determination result" in the section (1) is "hand present" and "first hand detection determination result" in the section (2) is "hand absent," the hand detection determination unit 22 determines that "the hand has been removed during the operation of the blower unit 6."

When it is not determined that "the hand has been removed during the operation of the blower unit 6" (i.e., "No" at step S230), on the other hand, the hand detection determination unit 22 outputs a sensor stop instruction signal to the hand detection sensor 11, and the process proceeds to step S50. In this regard, when the final "hand detection determination result" in the section (1) is "hand present," and "first hand detection determination result" in the section (2) is "hand present," the hand detection determination unit 22 does not determine that "the hand has been removed during the operation of the blower unit 6."

At step S240, the hand detection determination unit 22 determines whether 25 ms has elapsed, which is a sum of the predefined driving period of 20 ms and the predefined driving extension time period of 5 ms, since the start of driving of the hand detection sensor 11. When 25 ms has not yet elapsed (i.e., "No" at step S240), the process returns to step S240. When 25 ms has elapsed (i.e., "Yes" at step S240), on the other hand, the process proceeds to step S250.

At step S250, when the driving extension time period has elapsed, that is, when 25 ms has elapsed since the start of driving of the hand detection sensor 11, the hand detection determination unit 22 makes the "second hand detection determination" in the section (2) to make a determination that is "hand present" or "hand absent". Then, at step S250, the hand detection determination unit 22 outputs a sensor stop instruction signal to the hand detection sensor 11.

Next, at step S260, the hand detection determination unit 22 makes a comparison between "first hand detection determination" and "second hand detection determination" in the section (2) to make a final hand detection determination, and thus determines the final "hand detection determination result" in the section (2). The hand detection determination unit 22 then determines whether the final "hand detection determination result" in the section (2) is "hand absent."

If the final "hand detection determination result" in the section (2) is "hand absent" (i.e., "Yes" at step S260), the hand detection determination unit 22 determines that "the hand has been removed during the operation of the blower unit 6," and the process proceeds to step S270. At step S270, the hand detection determination unit 22 outputs an operation stop signal to the blower unit 6, and the blower unit 6 then stops operation in accordance with the operation stop signal.

When the final "hand detection determination result" in the section (2) is not "hand absent" (i.e., "No" at step S260), on the other hand, the hand detection determination unit 22 does not determine that "the hand has been removed during the operation of the blower unit 6," and the process proceeds to step S50. Then, at step S50, the hand detection sensor 11 stops in accordance with the sensor stop instruction signal. Then, the process proceeds to step S60 similarly to the foregoing, and the process returns to step S40.

For purposes of illustration, the above example describes the hand detection sensor 11 as stopping in accordance with the sensor stop instruction signal at step S50 after step S170 and after step S270. However, in fact, the hand detection sensor 11 stops immediately after the sensor control unit 21 outputs the sensor stop instruction signal to the hand detection sensor 11.

As described above, the hand dryer device 1 according to the present embodiment controls the blower unit 6 on the basis of the two "hand detection determinations", as illustrated in steps S120 and S150 when the blower unit 6 stops, and in steps S220 and S250 when the blower unit 6 is in operation, respectively. Making the final "hand detection determination" on the basis of the plural "hand detection determinations" in the above stated manner can prevent false detection of hand due to noise or the like, and can thus improve hand detection accuracy.

Moreover, the hand dryer device 1 according to the present embodiment extends the driving period of the hand detection sensor 11 to make the plural "hand detection determinations" in one driving cycle, as illustrated in step S140 and in step S240. The hand dryer device 1 then performs control to complete the final "hand detection determination" within one driving cycle. This allows the hand dryer device 1 according to the present embodiment to reduce the time necessary for the hand detection determination.

Furthermore, the hand dryer device 1 according to the present embodiment drives the hand detection sensor 11 continuously until the "second hand detection determination" in "driving cycle B". This eliminates the need for the hand dryer device 1 to wait for stabilization of the intensity of light emitted from the light-emitting element of the hand detection sensor 11 with respect to the "second hand detection determination." Thus, the power consumption when a "second hand detection determination" is made can be reduced to 25/100 in a ratio relative to continuous operation, instead of 40/100 in a ratio relative to continuous operation, which is twice the power consumption when the "first hand detection determination" is made.

Although the present embodiment assumes that the control to extend the driving period of the hand detection sensor 11 is applied both when the hand is inserted and when the hand is removed, the control may be applied only when the hand is inserted. Such control is advantageous, for example, in that the blower unit 6 can be quickly activated with the aid of inertial rotation of the motor of the blower unit 6 when the blower unit 6 is desired not to stop immediately after the removal of the hand, for example, when plural users use the hand dryer device 1 one after another.

The hand dryer device 1 according to the present embodiment, which intermittently drives the hand detection sensor to make the "hand detection determination", achieves both reduction or prevention of malfunction due to noise and reduction in time necessary for the hand detection, as described above. Thus, the hand dryer device 1 according to the present embodiment is a hand dryer device that achieves improved hand detection accuracy, starts to operate quickly, and is user friendly.

The configuration of the embodiment described above is only an example of the disclosed implementation of the present invention, and may thus be combined with other known technology. In addition, a portion of the configuration may be omitted and/or modified without departing from the spirit of the present invention.

The present embodiment has been described as a hand dryer device including the housing 2 forming therein the hand drying portion 3 defining a hand-insertable recessed space that is a drying space for drying the hand, the hand dryer device including the hand drying nozzles 3*a* and 3*b* for emitting jets of air toward the hand drying portion 3. However, the configuration of the hand dryer device is not limited thereto. For example, the hand dryer device may be configured to have a nozzle 3*a* on a bottom surface of a box-shaped housing 2 to blow air in a downward direction to an outside space of the housing 2, such that the airflow from the nozzle 3*a* is directed against the hand placed within a drying space under the housing 2 for drying the hand.

REFERENCE SIGNS LIST

1 hand dryer device; 2 housing; 2*a* front projection; 2*b* rear projection; 2*c* opening; 3 hand drying portion; 3*a*, 3*b* hand dryer nozzle; 4 water collector; 5 drain tank; 6 blower unit; 7 duct; 8 air intake; 9 air filter; 10*a* front discharge duct; 10*b* back discharge duct; 11 hand detection sensor; 12 control unit; 21 sensor control unit; 22 hand detection determination unit; 23 operation control unit; 24 basic operation control unit; 101 processor; 102 memory.

The invention claimed is:

1. A hand dryer device comprising:

a nozzle to blow an airflow into a drying space in which a hand is placeable;

a blower to generate the airflow to be blown out of the nozzle;

a hand detector having a light-emitting element to detect presence or absence of the hand in the drying space; and a controller to make a hand detection determination of whether the hand is present or absent in the drying space on the basis of a detection result of the hand detector, and to control driving of the blower on the basis of a determination result of the hand detection determination, wherein the controller is configured to control an intermittent driving of the light-emitting element of the hand detector by selectively timing outputting of a driving instruction signal or a stop instruction signal, the hand detector being configured to be driven in response to the driving instruction signal being output from the controller, and the hand detector being configured to stop in response to the stop instruction signal being output from the controller, and wherein, in consecutive first and second driving cycles of the hand detector, when the determination result in the first driving cycle and the first determination result in the second driving cycle differ from each other, the controller extends a driving period of the hand detector in the second driving cycle by selectively timing the outputting of the stop instruction signal.

2. The hand dryer device according to claim 1, wherein the controller extends the driving period of the hand detector in the second driving cycle when it is not determined that the hand is present in the first driving cycle while a first determination in the second driving cycle is a determination that the hand is present, the blower stopping in the first driving cycle and the second driving cycle.

3. The hand dryer device according to claim 1, wherein the controller extends the driving period of the hand detector in the second driving cycle when it is determined that the hand is present in the first driving cycle while a first determination in the second driving cycle is not a determination that the hand is present, the blower being in operation in the first driving cycle and the second driving cycle.

4. The hand dryer device according to claim 1, wherein the controller resets the driving period of a driving cycle of the hand detector to an original driving period after the second driving cycle terminates.

5. The hand dryer device according to claim 1, wherein the controller makes the hand detection determination during the extended driving period, and determines a determination result of a final hand detection determination in the second driving cycle on the basis of determination results of the plural hand detection determinations in the second driving cycle.

6. The hand dryer device according to claim 5, wherein the controller controls driving of the blower on the basis of the determination result of the final hand detection determination in the second driving cycle.

7. The hand dryer device according to claim 6, wherein:

when, during stop of the blower, it is consecutively determined that the hand is present as the determination results of the plural hand detection determinations in the second driving cycle, the controller operates the blower; and when, during operation of the blower, it is consecutively determined that the hand is absent as the determination results of the plural hand detection determinations in the second driving cycle, the controller stops the blower.

8. The hand dryer device according to claim 6, wherein the controller determines the determination result of the final hand detection determination in the second driving cycle by using a majority decision among determination results of the plural hand detection determinations in the second driving cycle.

9. The hand dryer device according to claim 8, wherein the controller performs the majority decision at a time of each of the second and subsequent ones of the hand detection determinations in the second driving cycle, and when the majority decision fails to be finalized, the driving period of the hand detector is extended up to a predefined number of times.

10. The hand dryer device according to claim 9, wherein in the majority decision, the controller neither extends the driving period of the hand detector nor makes the hand detection determination after the majority decision is finalized by a smaller number of times of the hand detection determinations than a predefined number of times of the hand detection determinations.

11. The hand dryer device according to claim 1, wherein the stop instruction signal of which the outputting is selectively timed causes the light-emitting element to turn OFF.

* * * * *